US011993993B2

(12) United States Patent
Falnes et al.

(10) Patent No.: US 11,993,993 B2
(45) Date of Patent: May 28, 2024

(54) DEFLECTOR-LESS MULTILATERAL SYSTEM USING A BUOYANT GUIDE SUB

(71) Applicant: Halliburton Energy Services, Inc., Houston, TX (US)

(72) Inventors: Morten Falnes, Stavanger (NO); Angus Mackay Barron, Aberdeenshire (GB); Mark C. Glaser, Spring, TX (US); Michael Linley Fripp, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/674,418

(22) Filed: Feb. 17, 2022

(65) Prior Publication Data

US 2023/0258048 A1 Aug. 17, 2023

(51) Int. Cl.
*E21B 23/12* (2006.01)
*E21B 7/06* (2006.01)

(52) U.S. Cl.
CPC ..... *E21B 23/12* (2020.05); *E21B 7/061* (2013.01)

(58) Field of Classification Search
CPC ..... E21B 7/061; E21B 17/012; E21B 17/14; E21B 23/12; E21B 33/13; E21B 34/063; E21B 43/10
See application file for complete search history.

(56) References Cited

U.S. PATENT DOCUMENTS

| | | | | |
|---|---|---|---|---|
| 3,526,280 | A | 9/1970 | Aulick | |
| 2003/0192699 | A1 | 10/2003 | Gano | |
| 2012/0061141 | A1 | 3/2012 | Rossing | |
| 2012/0261130 | A1 | 10/2012 | Linn et al. | |
| 2014/0116728 | A1 | 5/2014 | Zhou | |
| 2015/0107843 | A1 | 4/2015 | Talley et al. | |
| 2016/0333658 | A1* | 11/2016 | Keshishian | E21B 37/10 |
| 2018/0080308 | A1* | 3/2018 | Dedman | E21B 34/063 |
| 2019/0169954 | A1* | 6/2019 | Cabot | E21B 27/02 |
| 2019/0234163 | A1 | 8/2019 | Glaser et al. | |
| 2019/0352994 | A1* | 11/2019 | Giroux | E21B 33/1208 |
| 2022/0412192 | A1 | 12/2022 | Glaser et al. | |

* cited by examiner

*Primary Examiner* — Tara Schimpf
*Assistant Examiner* — Lamia Quaim
(74) *Attorney, Agent, or Firm* — Scott Richardson; Parker Justiss, P.C.

(57) ABSTRACT

Provided is a buoyant guide sub for use with a downhole oilfield conveyance. The buoyant guide sub, in one aspect, includes a hollow tubular structure, the hollow tubular structure including one or more tubular walls. The buoyant guide sub, according to at least one aspect, further includes a housing coupled to and slidable relative to the hollow tubular structure, the hollow tubular structure and the housing operable to form a pressurized chamber, the hollow tubular structure and housing having a combined mass per unit volume less than a specific gravity of 2.

17 Claims, 13 Drawing Sheets

DEFLECTOR-LESS MULTILATERAL SYSTEM USING A BUOYANT GUIDE SUB

BACKGROUND

A typical hydrocarbon well is formed by drilling a wellbore using a rotary drill bit at the end of a drill string. The drill string is progressively assembled by adding segments of tubing string at the surface of the wellsite until a desired depth is reached. The wellbore may be drilled along any desired wellbore path with the use of a directional drilling system. The well may therefore include one or more vertical, horizontal, or otherwise deviated borehole sections, to reach a target formation. For example, a well may be drilled with a long, vertical section extending from the surface of the wellsite to a certain vertical depth, before angling sideways to reach the target formation. The drill string may be retrieved, and portions of the wellbore may be reinforced with a metallic casing string cemented in place downhole.

A multilateral well is a well formed with one or more secondary wellbores that branch off another primary wellbore. To construct a multilateral well, a primary wellbore is drilled, and a casing joint may be installed at the desired junction location. A deflector is then positioned at the desired junction location along the primary wellbore and anchored in place. The deflector is used to guide the milling of a window through the casing of the primary wellbore, and to subsequently guide a drill bit through the window to drill the secondary wellbore. The result is a multilateral junction where the two wellbores intersect. The multilateral junction can be reinforced, and the secondary wellbore may be completed for production of hydrocarbons through the secondary wellbore.

BRIEF DESCRIPTION

Reference is now made to the following descriptions taken in conjunction with the accompanying drawings, in which.

DETAILED DESCRIPTION

The present disclosure is directed to systems and methods for navigating a multilateral wellbore in the vicinity of a multilateral junction. More specifically, the disclosure addresses the challenges of traversing a multilateral junction that has a low-side exit from a primary wellbore to a secondary wellbore, or alternatively a high-side exit from the primary wellbore to the secondary wellbore. Conventionally, the mass of a conventional oilfield conveyance would cause the oilfield conveyance to veer into the lower of the primary wellbore or secondary wellbore when attempting to traverse the multilateral junction. One aspect of this disclosure is a buoyant guide sub configured to guide the oilfield conveyance (e.g., oilfield tubular, including tubing string and coiled tubing, wireline, slickline, etc.) to the higher of the primary wellbore or secondary wellbore.

The buoyant guide sub may be tripped downhole on an oilfield conveyance. The buoyancy of the buoyant guide sub is used to bias the buoyant guide sub toward the higher of the primary wellbore or secondary wellbore, to avoid the oilfield conveyance veering out the lower of the primary wellbore or secondary wellbore. Once the buoyant guide sub has traversed the multilateral junction, the buoyant guide sub may be used to guide the rest of the oilfield conveyance or a tubular component thereof across the junction. Alternatively, the buoyant guide sub may remain in place to serve as a floating conduit for service work in the downstream portion of the wellbore. With the disclosed systems and methods, the higher of the primary wellbore or secondary wellbore may be accessed without the need for a deflector. Accordingly, issues related to positioning the deflector at the optimal lateral position, as well as rotational position, are no longer of concern.

A variety of example configurations and features are discussed. Generally, the buoyant guide sub may comprise a long tube formed of low-density materials, such as composite tubing. The buoyant guide sub may be capped at each end to form a sealed chamber filled with a gas. The gas may be pressurized to offset hydrostatic pressure downhole. The gas may be pre-pressurized above ground, or downhole using a floating piston or other pressure source. The buoyant guide sub may also be reinforced with a structural webbing, hollow glass microspheres, a rigid foam core, or a combination thereof. The low-density materials used in the buoyant guide sub provide buoyancy to the buoyant guide sub while traveling through a well fluid in the vicinity of the multilateral junction. The buoyant guide sub may also be formed of dissolvable materials, and/or the ends of the sealed chamber may be burst by applied pressure or drilled to provide through-tube access for subsequent delivery of fluids or tubular components.

Figure 1:
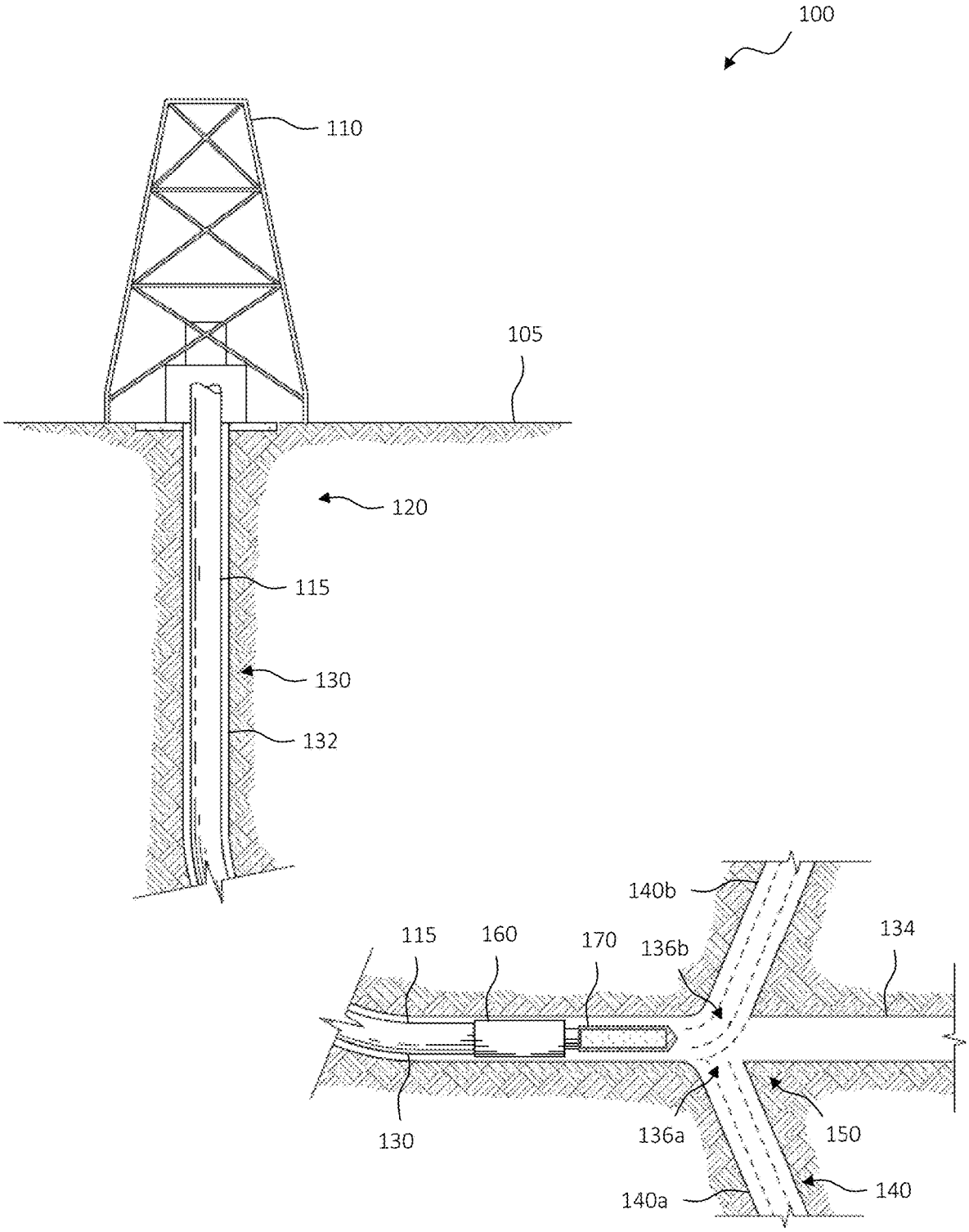
FIG. 1 illustrates an elevation view of an example well system for implementing aspects of this disclosure.

FIG. 1 is an elevation view of an example well system 100 for implementing aspects of this disclosure. A large support structure generally referred to as a rig 110 may be used for suspending and lowering an oilfield conveyance 115 into a multilateral well 120. Although the rig 110 is depicted as being land-based, the disclosed principles could be applied in a multilateral well at any other well site, such as an offshore or floating platform. The oilfield conveyance 115 may be assembled from individual tubing segments and tools as it is progressively lowered into the multilateral well 120, in which case equipment would be included for helping to make up and break out those connections. The rig 110 may alternatively support coiled tubing operations that use a long, continuous supply of tubing rather than assembling and disassembling the oilfield conveyance 115 from discrete segments, or alternatively even wireline, slickline, etc. Various other equipment known in the art is provided at the well system 100 for supporting well operations such as the delivery or return of fluids, power, and electrical communication downhole.

The multilateral well 120 includes a primary wellbore 130 drilled from a surface 105 of the well system 100 and at least one secondary wellbore 140 (e.g., low-side secondary wellbore 140*a* and high-side secondary wellbore 140*b* in the illustrated embodiment) branching off the primary wellbore 130, which together form a multilateral junction 150 in the drilled formation. The term "primary wellbore" is broadly used herein to refer to any wellbore intersected by another wellbore (the lateral or "secondary wellbore"). In this example, the primary wellbore 130 is the main wellbore of this multilateral junction 150 and the secondary wellbore(s) 140*a*, 140*b* are the lateral wellbore(s) of the multilateral junction 150. However, the disclosed principles are applicable to any multilateral junction, and is not limited to those involving the primary wellbore drilled from surface.

The primary wellbore 130 may follow a given wellbore path. In the FIG. 1 example, the first portion of the primary wellbore 130 is a long, vertical section 132 drilled from a surface 105 of the well system 100. Directional drilling techniques are then used to deviate away from vertical to form a horizontal section 134, which is also part of the primary wellbore 130. A window is then formed in the horizontal section 134 of the primary wellbore 130, and the secondary wellbore 140 may then be drilled. In the illustrated embodiment of FIG. 1, the secondary wellbore 140*a* is drilled at a low-side exit 136*a* from the horizontal section 134 of the primary wellbore 130, and the secondary wellbore 140*b* is drilled at a high-side exit 136*b* from the horizontal section 134 of the primary wellbore 130.

For ease of illustration, the low-side exit 136*a* is drawn facing vertically downward, the horizontal section 134 is drawn at ninety degrees to the surface (perpendicular to gravitational force), and the high-side exit 136*b* is drawn facing vertically upward. However, the low-side exit may be any exit to a secondary wellbore along a non-vertical primary wellbore such that the ordinary mass of heavy tubing might cause an oilfield conveyance to veer out the low-side exit into the secondary wellbore, and the high side exit may any exit to a secondary wellbore along a non-vertical primary wellbore such that the ordinary mass of heavy tubing might cause an oilfield conveyance to stay within the primary wellbore and not veer out the high-side exit into the secondary wellbore.

Having drilled the multilateral well 120 in the formation, portions of the wellbore may be completed by tripping tubular componentry downhole and installing it on the oilfield conveyance 115. For example, the oilfield conveyance 115 is shown in FIG. 1 being lowered into the primary wellbore 130 from the surface 105 down to the horizontal section 134 of the primary wellbore 130, with a tubular component 160 carried on the oilfield conveyance 115. The oilfield conveyance 115 and tubular component 160 may comprise tubing of heavy steel or other metallic materials.

A buoyant guide sub 170 accordingly to this disclosure is positioned at a leading end of the oilfield conveyance 115, ahead of the tubular component 160. The buoyant guide sub 170 is a buoyant member that is capable of floating in a well fluid. The buoyancy of the buoyant guide sub 170 may urge the buoyant guide sub 170 to a high side, whether that be to a high side of the primary wellbore 130 above the low-side exit 136*a*, or a high side of the high-side exit 136*b* above the primary wellbore 130. The buoyant guide sub 170 may be used, as further discussed below, to help guide the tubular component 160 or the oilfield conveyance 115 to the high-side and across the multilateral junction 150, whether a low-side exit 136*a* exists and the buoyant guide sub 170 keeps the tubular component 160 or the oilfield conveyance 115 in a downhole portion of the primary wellbore 130, or a high-side exit 136*b* exists and the buoyant guide sub 170 keeps the tubular component 160 or the oilfield conveyance 115 in a downhole portion of the secondary wellbore 140*b*.

Aspects of this disclosure are useful in both installing the completions and later servicing the well upon completion. The oilfield conveyance 115 may be a completions string or a work string for installing or servicing the well, among others. The tubular component 160 carried on the oilfield conveyance 115 may include tubular members for lining and reinforcing the primary wellbore 130 and/or secondary wellbore(s) 140*a*, 140*b*.

Figure 2A:
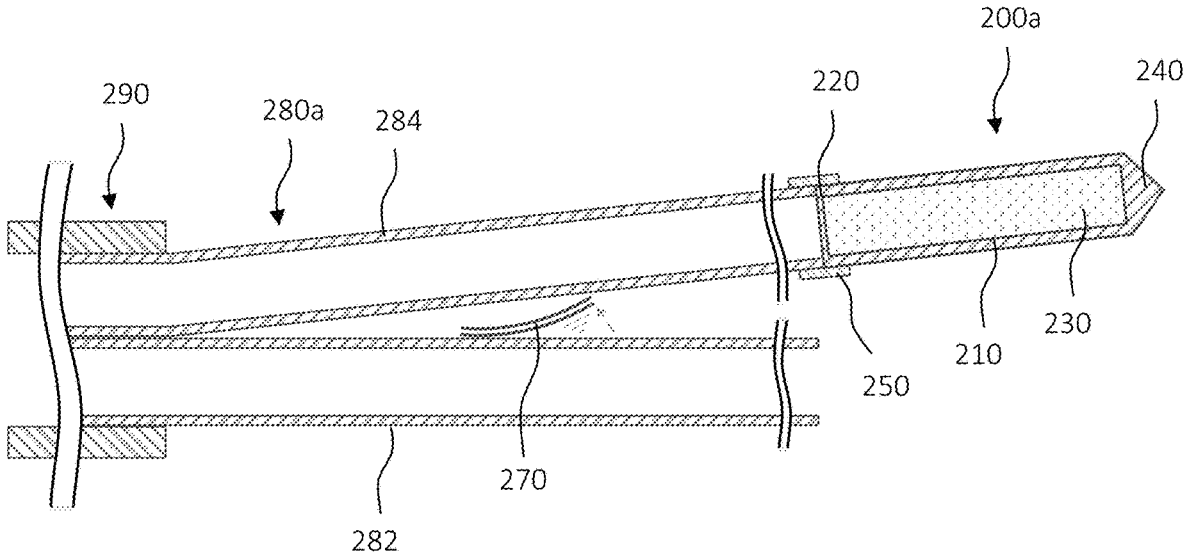
FIGS. 2A and 2B illustrate example configurations of a buoyant guide sub designed, manufactured and operated according to one or more alternative embodiments of the disclosure.

FIG. 2A is an example configuration of the buoyant guide sub 200*a* designed, manufactured. and operated according to one or more alternative embodiments of the disclosure. The buoyant guide sub 200*a*, in the illustrated embodiment, is coupled to a multilateral junction assembly 280*a* at a leading end of an oilfield conveyance 290. The multilateral junction assembly 280*a*, in at least one embodiment, is for reinforcing a multilateral junction formed in an earthen formation. The multilateral junction assembly 280*a* includes a primary wellbore leg 282 configured for insertion into the primary wellbore of a multilateral junction, and a secondary wellbore leg 284 configured for insertion into the secondary wellbore of the junction. In the illustrated embodiment, the secondary wellbore leg 284 is on a high-side of the primary wellbore leg 282, and thus aligned for a high-side secondary wellbore exit. The primary wellbore leg 282 and secondary wellbore leg 284 are generally tubular structures that may be run downhole together on the end of the oilfield conveyance 290. The mass and downwardly-angled profile of the primary wellbore leg 282 allows the primary wellbore leg 282 to be readily landed in the primary wellbore. However, the buoyant guide sub 200*a* is provided to guide the secondary wellbore leg 284 up into the high-side exit to the downstream portion of the secondary wellbore while allowing the primary wellbore leg 282 to remain in the primary wellbore.

The buoyant guide sub 200*a* in this example comprises a hollow tubular structure, with a tubular wall 210 formed of a low-density material, such as fiberglass or carbon fiber, among others. These materials are considerably lower density than most metallic materials used in conventional oilfield conveyance (e.g., oilfield tubulars), and the lower density can therefore contribute to producing a relatively lightweight structure as compared with conventional oilfield conveyances. In at least some embodiments, the low-density material used in the tubular wall 210 may have a specific gravity of less than 3, whereas most metallic materials used in conventional oilfield conveyances have a specific gravity greater than 7.5. The ends of the tubular wall 210 are initially closed with end caps 220, to define a sealed tubular interior chamber filled with a gas 230. A nose 240 of the buoyant guide sub 200*a* may have a pointed, tapered, rounded, or otherwise contoured shape to help guide the buoyant guide sub 200*a* into position when traversing into the secondary wellbore. The nose 240 of the buoyant guide sub 200*a* may be axisymmetric or it may be asymmetric for easier passage into the wellbore. The gas within the buoyant guide sub 200*a* may be pressurized at surface. Alternatively, one of the end caps 220 may be configured as a floating piston axially moveable within the tubular wall 210, which may be used to pressurize the gas 230.

In other embodiments, one or more components of the buoyant guide sub 200*a* may be formed of a dissolvable or degradable material to be disintegrated after traversing a multilateral junction, to allow passage of fluid or components across the junction. In one embodiment, the entire buoyant guide sub 200*a* could be degraded after it has guided the oilfield conveyance or tubular component in the downstream portion of the secondary wellbore. In another example, just the end caps 210 are dissolvable or degradable, so that flow can be established through the buoyant guide sub 200*a* after traversing the multilateral junction. In some configurations a dissolvable metal may be used, such as magnesium alloy or aluminum alloy. In other configurations, a degradable polymer may be used, such as an aliphatic and aromatic polyesters, a thermoplastic epoxy, or a urethane. In some configurations, the polymer is constructed from polymers such as PEEK, ABS, PVC, or cross-linked polyethylene (XPE). These are lower density materials than most of the metallic materials used in oilfield conveyances. In another configuration, the polymer has closed-cell pores of air within the body. In one embodiment, the closed-cell pores of air have a size less than 5 mm in order to be able to withstand the hydrostatic pressure. In another embodiment, the polymer has a porosity greater than 20%. Examples of methods for constructing a polymer with closed-cell pores includes creating a foam, additive manufacturing, and bonding pre-molded parts to form enclosed pores.

In another example, a polymer can be compounded with a low-density material. The specific gravity of the low-density material is less than the specific gravity of the polymer. Examples of low-density material include ultra-low-density polymers, a syntactic foam, and low-density particles such as a hollow glass microsphere, hollow ceramic microsphere. In one example, a degradable polymer can be compounded with hollow glass microspheres to further reduce the density. Glass microspheres can have a crush strength greater than the hydrostatic pressure. In one example, a buoyant guide sub 200*a* constructed from epoxy and glass microspheres may have a specific gravity less than 1 (e.g., would float in ordinary water) and degrade within 2 weeks in salt brine at 150 degrees Celsius. In another example, a buoyant guide sub 200*a* (e.g., constructed from magnesium alloy that encloses an air space) has a specific gravity less than 1.5 (e.g., would float in a 13 ppg mud) and would degrade within 2 days in a salt brine at 250 degrees Celsius. In yet another example, a buoyant guide sub 200*a* has a specific gravity less than 2 (e.g., would float in a 17 ppg mud). If faster dissolution is desired, then a fluid could be circulated to depth to aid the degradation, such as an acid.

The lightweight tubular structure filled with the gas 230 gives the buoyant guide sub 200*a* of FIG. 2A buoyancy. The gas 230 has a much lower density than any non-gaseous fluid (e.g., mud) that may be present in the multilateral well. The low-density material of the sidewall, though heavier than compressed gas, is significantly lower density than metallic materials. The resulting construction of the buoyant guide sub 200*a* has a combined mass per volume that is lower than the specific gravity of the well fluid, and in most cases may be less than the specific gravity of water. The gas 230 may also be pressurized to counter the hydrostatic pressure downhole.

The buoyancy of the buoyant guide sub 200*a* may be proportional to the difference in the total mass per unit volume of the buoyant guide sub 200*a* and the mass per unit volume of the well fluid in which it is submerged. The well fluid may be, for example, a weighted fluid ("mud") used to balance pore pressure, a formation fluid, water, or combination thereof. A typical density of the well fluid is equal to or greater than the density of water (e.g., the well fluid may have a specific gravity of greater than 1). Therefore, the buoyant guide sub 200*a* should float in the well fluid so long as the mass per volume of the buoyant guide sub is no heavier than water. For a reliable safety margin and increased buoyancy, the buoyant guide sub 200*a* could be designed to have a buoyancy of less than the specific gravity of water.

The upward bias provided by the buoyancy of the buoyant guide sub 200*a* may be supplemented using any suitable mechanical spring. For example, one or more optional leaf springs 270 are secured to the buoyant guide sub 200*a* along the high side of the primary wellbore leg 282. The leaf springs 270 may be angled and/or curved outwardly in a relaxed state, so they flex inwardly when they enter a bore, to bias the buoyant guide sub 200*a* upwardly. The spring may also be a coil spring or a Belville spring.

Figure 3A:
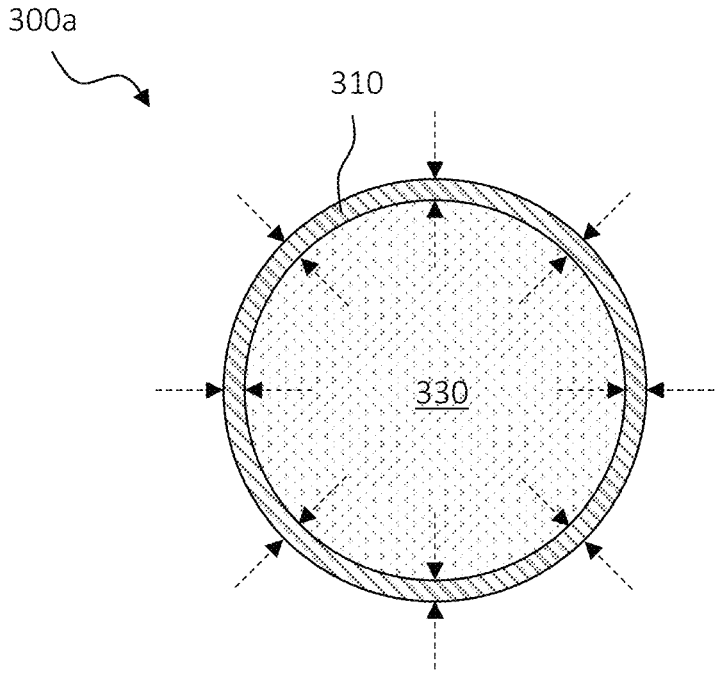
FIGS. 3A to 3C illustrate various alternative constructions of a buoyant guide sub according to one or more embodiments of the disclosure that provide a degree of stiffness and/or buoyancy.
Figure 3B:
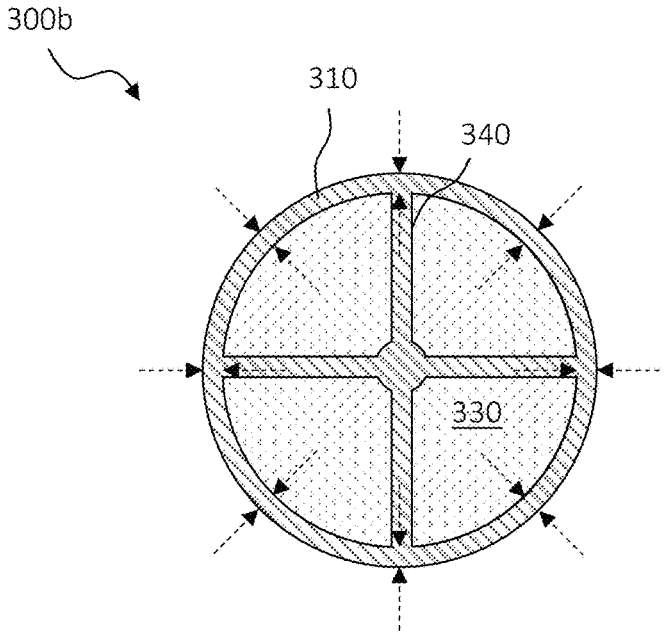
Figure 3C:
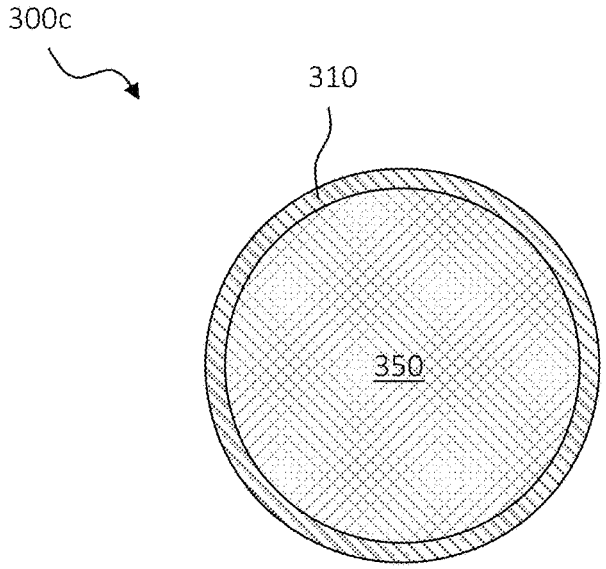

FIGS. 3A to 3C illustrate various alternative constructions of a buoyant guide sub 300 according to one or more embodiments of the disclosure that provide a degree of stiffness and/or buoyancy. FIG. 3A is a cross-sectional view of the buoyant guide sub 300*a* having a hollow tubular structure filled with a pressurized gas. The tubing wall 310 of the buoyant guide sub 300*a* may be a lightweight composite material such as fiberglass or carbon fiber. Although a composite tube structure may have good stiffness along its length, it can be more vulnerable to compression such as from hydrostatic pressure of a well fluid. Therefore, the gas 330 sealed within the tubing may be pressurized to offset that hydrostatic pressure. The gas may be pressurized to the hydrostatic pressure, but in one or more embodiments is pressurized to a value less than the hydrostatic pressure, such as between atmospheric pressure and ⅔ of the hydrostatic pressure.

FIG. 3B is a cross-sectional view of an alternative example configuration of the buoyant guide sub 300*b*, wherein the tubing 310 is further reinforced by a rigid structural member. The rigid structural member, in at least one embodiment, comprises an internal web 340 that runs along the length of the buoyant guide sub 300*b* (e.g., into the page). The web 340 in this example has an X-shaped cross-section, but any other web shapes are within the scope of this disclosure that provide sufficient rigidity and buoyancy such as a lattice shape. In other embodiments, the web 340 is discontinuous along the length, and for example can be shaped as pillars. The exterior surface of the reinforced buoyant guide sub 300*b*, may have a thickness that varies in order to have a consistent stress in the material. The voids between the web 340 and the tubing wall 310 may be filled with the pressurized gas 330 to help offset hydrostatic pressure.

FIG. 3C is a cross-sectional view of yet another example configuration of the buoyant guide sub 300*c*, wherein the composite tubing is filled with a structural core 350 comprised of a low-density material, rather than a compressed gas. In one embodiment, the low-density material in the structural core 350 is a structural foam. The structural foam of the structural core 350 may be open-cell or closed cell. In one embodiment, the closed cell foam is a syntactic foam. In another embodiment, the structural core 350 comprises hollow ceramic spheres. Notwithstanding that certain examples of low-density materials have been provided for the structural core 350, any of the above mentioned low-density materials could be used and remain within the scope of the disclosure. The low-density material of the structural core 350 may have a compressive strength high enough to offset hydrostatic pressure to prevent collapse of the tubing wall 310, and a density low enough to still provide buoyancy to the buoyant guide sub 300*c*. The structural core 350 may also ensure the tubing wall remains a uniform diameter along its length so that oriented composite fibers remain in tension for a good stiffness-to-mass ratio.

Any of the example structures of FIGS. 3A to 3C may be used for the buoyant guide sub 200*a* of FIG. 2A. Referring again to FIG. 2A, the buoyant guide sub 200*a* may be coupled end-to-end with the secondary wellbore leg 284 of the multilateral junction assembly with a coupler 250. The coupler 250 may comprise a sleeve with opposing ends that receive the buoyant guide sub 200*a* at one end and the multilateral junction assembly 280*a* at the other end. The coupler 250 may comprise a threaded pin/box connection, a slip-fit connection, a threaded connection, an epoxied connection, or any other suitable connection for coupling tubular members end to end.

Figure 2B:
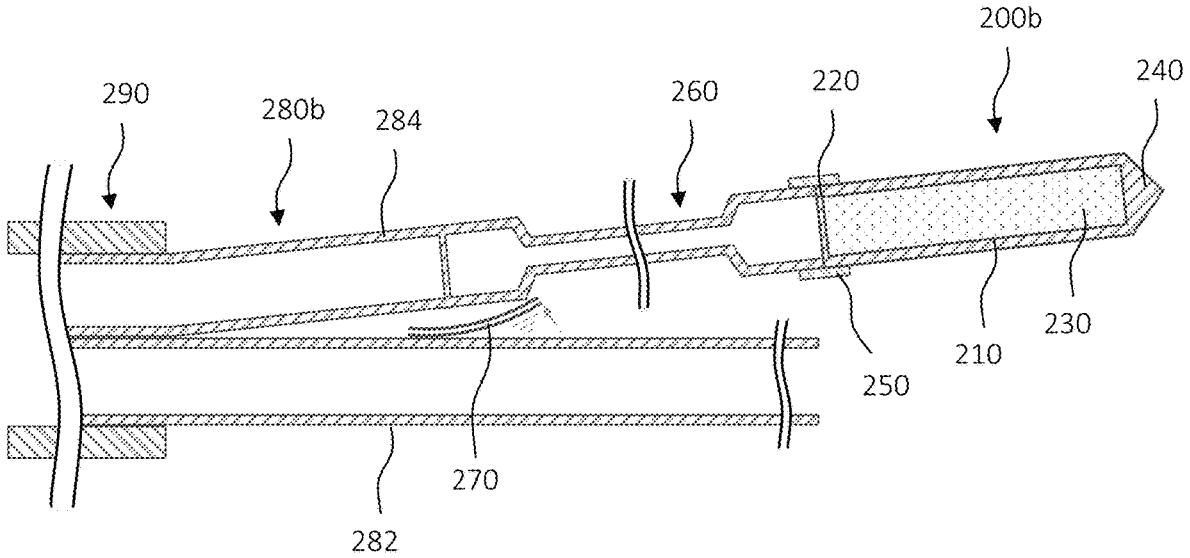

Turning to FIG. 2B, illustrated is an example configuration of a buoyant guide sub 200*b* and a multilateral junction assembly 280*b* designed, manufactured. and operated according to one or more other alternative embodiments of the disclosure. The buoyant guide sub 200*b* and multilateral junction assembly 280*b* of FIG. 2B are similar in many respects to the buoyant guide sub 200*a* and multilateral junction assembly 280*a* of FIG. 2A. Accordingly, like reference numbers have been used to indicate similar, if not identical features. The embodiment of FIG. 2B differs from the embodiment of FIG. 2A, for the most part, in that a transition sub 260 is positioned between the buoyant guide sub 200*b* and the secondary wellbore leg 284. The transition sub 260, in at least one embodiment, could have a submerged mass per length that is greater than the buoyant guide sub 200*b* and less than secondary wellbore leg 284. If the transition sub 260 did not exist, then buoyant guide sub 200*b* might conceivably have insufficient buoyancy to lift the heavy secondary wellbore leg 284 or insufficient mechanical strength to avoid breaking during either the lifting or during the entry into the multilateral junction. The buoyancy sub 200*b*, in at least the embodiment shown, has sufficient buoyancy force to lift the transition sub 260. The transition sub 260, in one or more embodiments, has sufficient strength to avoid breaking as the secondary wellbore leg 284 is lifted into the multilateral junction.

In one example, the transition sub 260 is constructed from a low-density material but with a thicker wall to provide increased mechanical strength. In the example shown in FIG. 2B, the transition sub 260 is constructed from a conventional oilfield metallic material, but with a much smaller cross-sectional area so that the submerged mass per unit length of the transition sub 260 is much less than the secondary wellbore leg 284. Any of the example structures of FIGS. 3A to 3C may also be used for the buoyant guide sub 200*b* of FIG. 2B. Moreover, the transition sub 260 may include a mechanically coupled linkage, such as hinges, knuckle joints or other forms of pivot joints that may have the potential to further ease the deflection of the transition sub 260.

Figure 4:
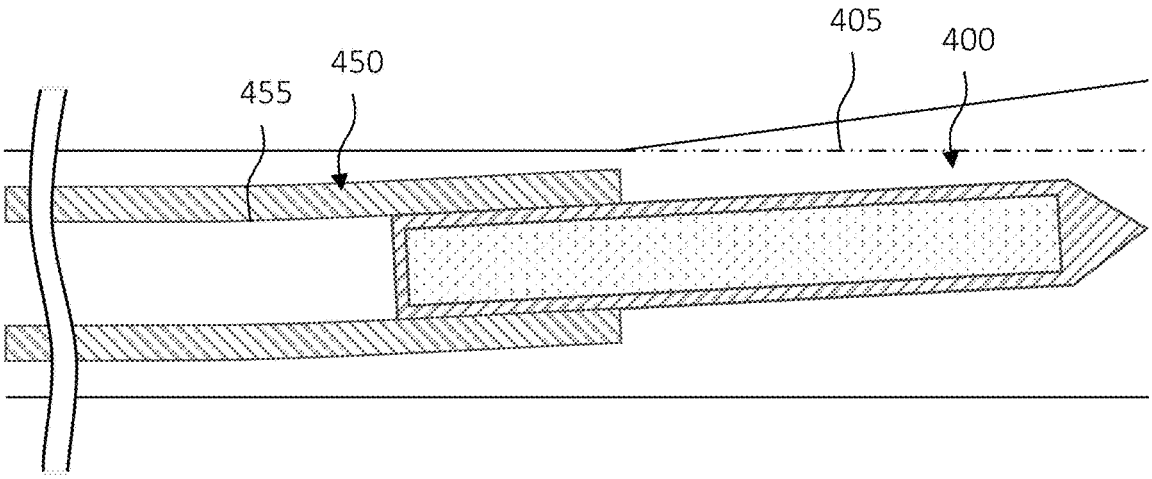
FIG. 4 illustrates a schematic side view of an embodiment wherein the buoyant guide sub is slidably disposed inside an interior of the tubular component.

FIG. 4 is a schematic side view of an embodiment wherein the buoyant guide sub 400 is slidably disposed inside an interior 455 of the tubular component 450. The tubular component 450 may be the secondary wellbore leg of the multilateral junction assembly (e.g., FIGS. 2A and 2B), for example. After the buoyant guide sub 400 has traversed the high-side exit 405, the tubular component 450 may be slid along the outside of the buoyant guide sub 400 to guide the tubular component 450 across the low-side exit.

Figure 5:
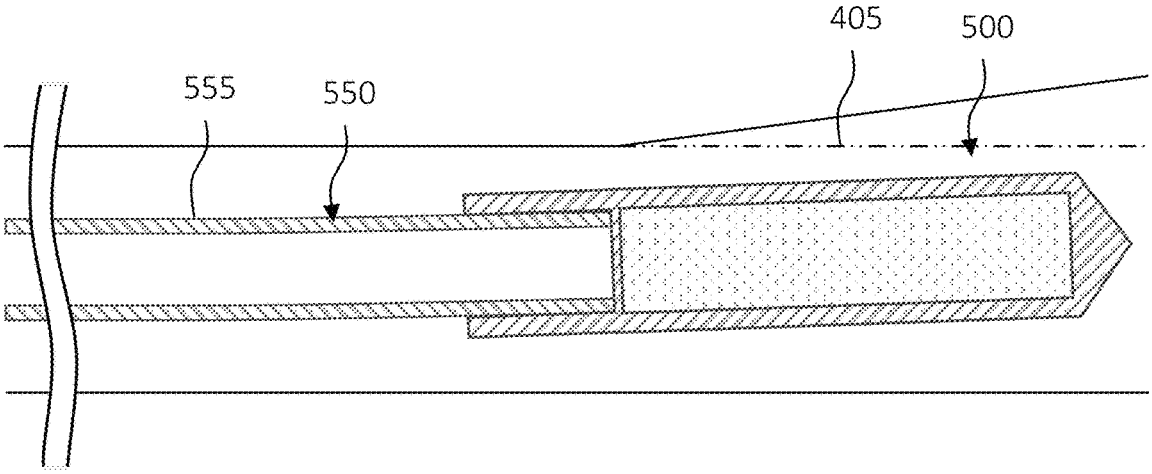
FIG. 5 illustrates a schematic side view of an alternative embodiment wherein the buoyant guide sub is instead slidably disposed about an exterior of the tubular component.

FIG. 5 is a schematic side view of an alternative embodiment wherein the buoyant guide sub 500 is instead slidably disposed about an exterior 555 of the tubular component 550. After the buoyant guide sub 500 has traversed the high-side exit 405, the tubular component 550 may slide along the inside of the buoyant guide sub 500 to guide the tubular component 650 across the high-side exit 405.

Figure 6A:
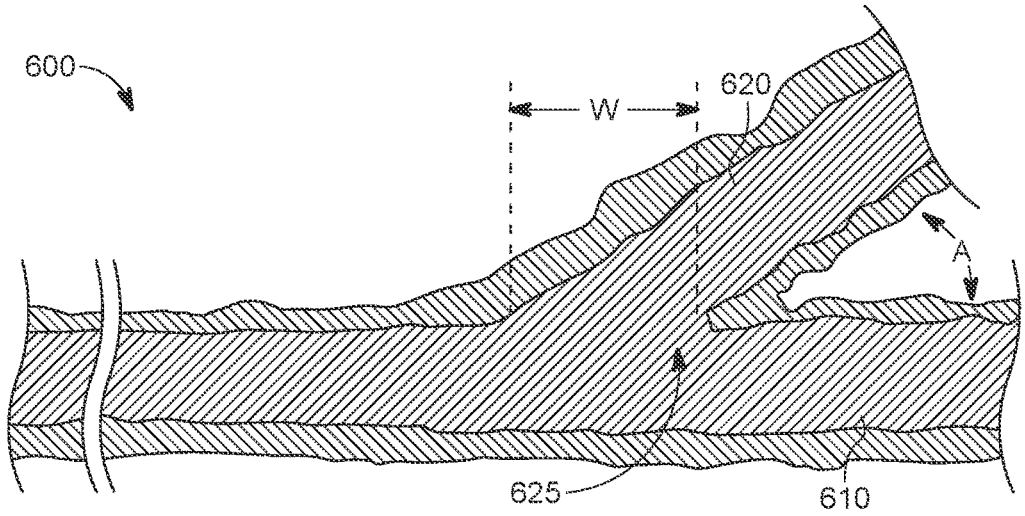
FIGS. 6A to 6D illustrate examples of using a buoyant guide sub to traverse a high-side exit of a multilateral junction in a well system.

FIGS. 6A to 6D now illustrate examples of using a buoyant guide sub to traverse a high-side exit of a multilateral junction in a well system 600. FIG. 6A is a schematic side view of a well system 600. The well system 600, in the illustrated embodiment, includes a primary wellbore 610 and a secondary wellbore 620 forming a multilateral junction 625. In the illustrated embodiment, the secondary wellbore 620 is a high-side secondary wellbore, and thus includes a high-side exit. Nevertheless, other embodiments exist wherein the secondary wellbore 620 is a low-side secondary wellbore. The scale (e.g., horizontal scale) of FIG. 6A is compressed for ease of illustration, to exaggerate the angle "A" as drawn and narrow the width "W" for ease of discussion. In reality, the angle A may be only about 2 to 3 degrees, and the width of the high-side exit may be tens of feet long (e.g., around 30 feet long). In the illustrated embodiment, the multilateral junction 625 is prepped for installation of a multilateral junction assembly. Further to the embodiment of FIG. 6A, no deflector assembly is required at the multilateral junction 625. While not necessary, other embodiments exist where a deflector assembly is still employed.

Figure 6B:
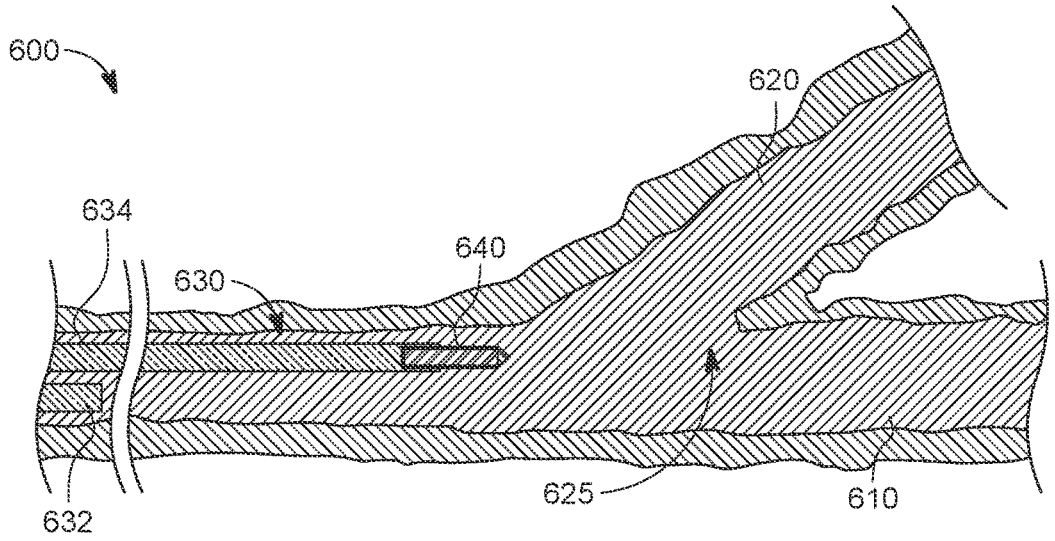

FIG. 6B is a schematic side view of the well system 600 of FIG. 6A with a multilateral junction assembly 630 traversing the primary wellbore 610. The multilateral junction assembly 630, in one or more embodiments, may be similar to the multilateral junction assembly 280*a* of FIGS. 2A and 2B, and thus may include a primary wellbore leg 632 and a secondary wellbore leg 634. In the illustrated embodiment, the multilateral junction assembly 630 is coupled to the secondary wellbore leg 634 using the general connection type similar to that of FIG. 4 (multilateral junction assembly internal to the tubular component). However, any suitable coupler configuration may be used such as the various alternatives described above.

In the illustrated embodiment, a buoyant guide sub 640 is coupled to the secondary wellbore leg 634. The buoyant guide sub 640 is similar to one or more of the buoyant guide subs designed, manufactured and/or operated according to the aspects of the disclosure. In at least one embodiment, the buoyant guide sub 640 is similar in one or more respects to the buoyant guide subs described in the paragraphs above.

The multilateral junction assembly 630, in the embodiment of FIG. 6B, has reached a portion of the primary wellbore 610 just upstream of the high-side exit. In the illustrated embodiment, the secondary wellbore leg 634 of the multilateral junction assembly 630 extends further forward than the primary wellbore leg 632. In other embodiments, the secondary wellbore leg 634 can be the same length or shorter than the primary wellbore leg 632.

Figure 6C:
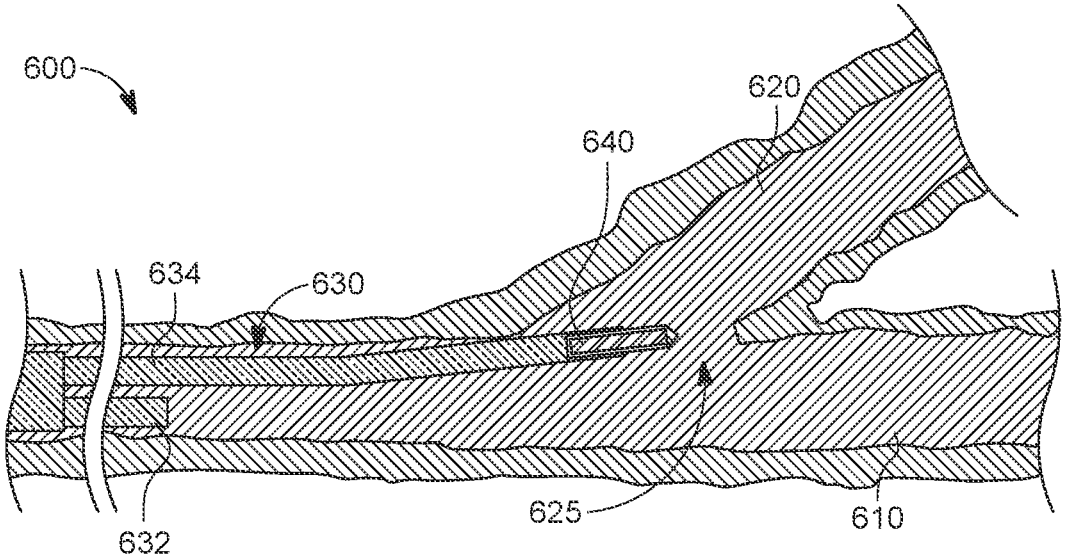

FIG. 6C is a schematic side view of the well system 600 of FIG. 6B with the multilateral junction assembly 630 advanced further down the primary wellbore 610 to where the buoyant guide sub 640 has now entered the high-side exit and begins to move the secondary wellbore leg 634 into the secondary wellbore 620.

Figure 6D:
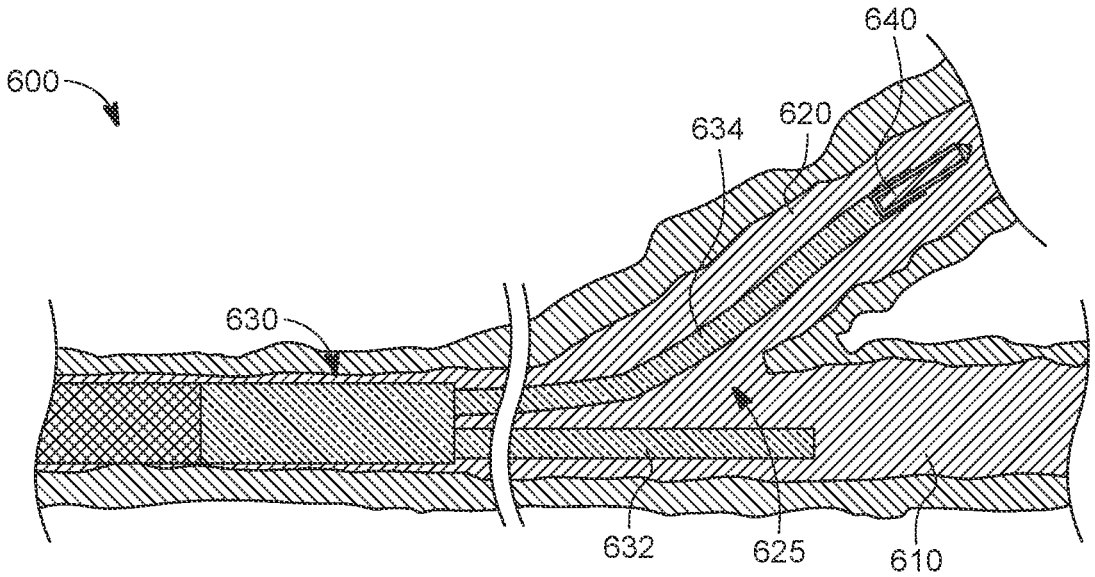

FIG. 6D is a schematic side view of the well system 600 of FIG. 6C with the multilateral junction assembly 630 advanced further down the primary wellbore 610. In the illustrated embodiment of FIG. 6D, the buoyant guide sub 640 has now fully entered the high-side exit and fully moved the secondary wellbore leg 634 into the secondary wellbore 620. Similarly, the primary wellbore leg 632 has entered a portion of the primary wellbore 610 downhole of the multilateral junction 625. Once the primary wellbore leg 632 and the secondary wellbore leg 634 have reached depth, the buoyant guide sub 640 may be dissolved or degraded as described above. Alternatively, the ends of the buoyant guide sub 640 may be punctured, ruptured, drilled, dissolved, or otherwise removed to establish flow down the oilfield conveyance (e.g., tubing string) to the downstream portion of the secondary wellbore 620.

In yet another embodiment, not shown, a buoyant guide sub (e.g., in addition to the buoyant guide sub 640, or apart from the buoyant guide sub 640) might be coupled to a leading edge of a logging tool or other intervention tool that is traversing the multilateral junction 630. For example, with the multilateral junction 630 in place, this other buoyant guide sub could be used to assist the logging tool or other intervention tool to access the secondary wellbore leg 632.

Figure 7A:
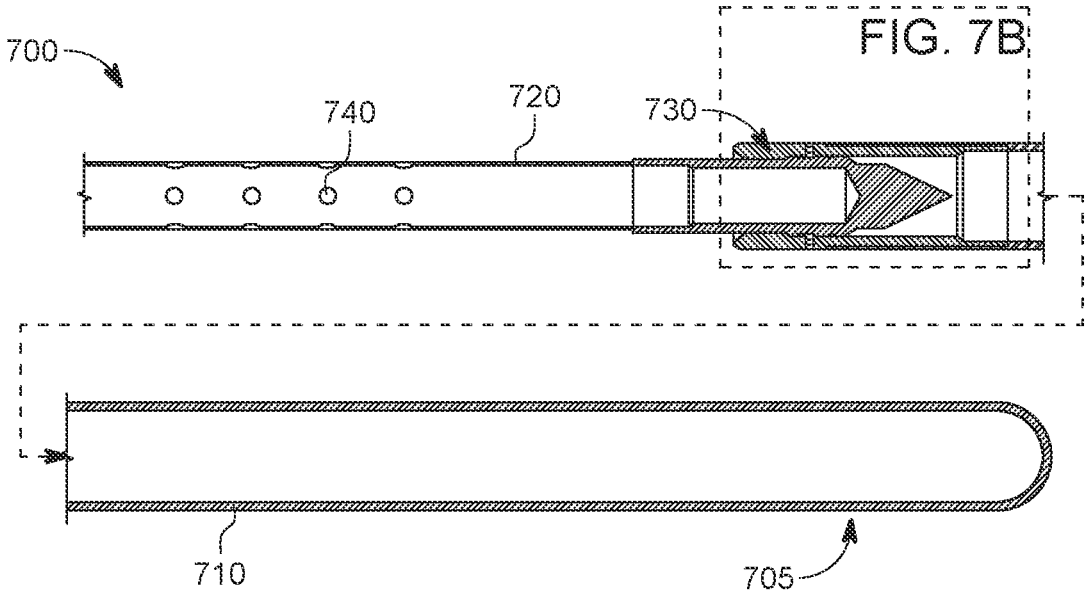
FIGS. 7A to 7B illustrate various different schematic cross-sectional views of a buoyant guide sub designed, manufactured and/or operated according to more or more alternative embodiments of the disclosure.

FIG. 7A is a schematic cross-sectional view of a buoyant guide sub 700 designed, manufactured and/or operated according to more or more alternative embodiments of the disclosure. The buoyant guide sub 700, in the illustrated embodiment, includes a hollow tubular structure 705, with one or more tubular walls 710 formed of a low-density material, such as fiberglass or carbon fiber, among others. These materials are considerably lower density than most metallic materials used in conventional oilfield conveyances, and the lower density can therefore contribute to producing a relatively lightweight structure as compared with conventional oilfield conveyances.

The buoyant guide sub 700, in the illustrated embodiment, may further include a housing 720, that is slidable relative to the hollow tubular structure 705. The housing 720, in at least one embodiment, may further include a piercing device 730. The piercing device 730 in at least one embodiment is configured to pierce an end of the hollow tubular structure 705 when the housing 720 slides far enough within the hollow tubular structure 705. In at least one embodiment, the housing 720 is a hollow housing that includes one or more production ports 740 therein, for example to receive production fluid from the wellbore after the buoyant guide sub 700 has landed and the piercing device 730 has pierced the hollow tubular structure 705.

Figure 7B:
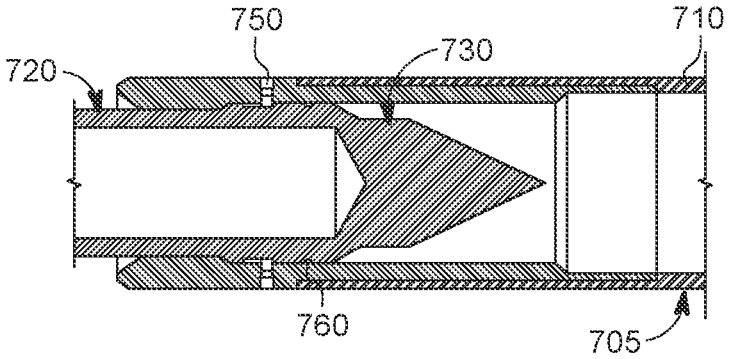

Turning briefly to FIG. 7B, illustrated is a zoomed in view of the piercing device 730 shown in FIG. 7A. As shown in FIG. 7B, the piercing device 730 may have one or more shear features 750 for temporarily fixing the tubular 720 relative to the hollow tubular structure 705. In at least one embodiment, the shear features 750 are shear pins or shear screws. Nevertheless, other shear features are within the scope of the disclosure. The piercing device 730, in one or more embodiments, may further include one or more seals 760. The one or more seals 760, which may be O-rings or other known seals, prevent fluids and/or gasses from entering and/or exiting the hollow tubular structure 705 until the shear features 750 have sheared.

Figure 8A:
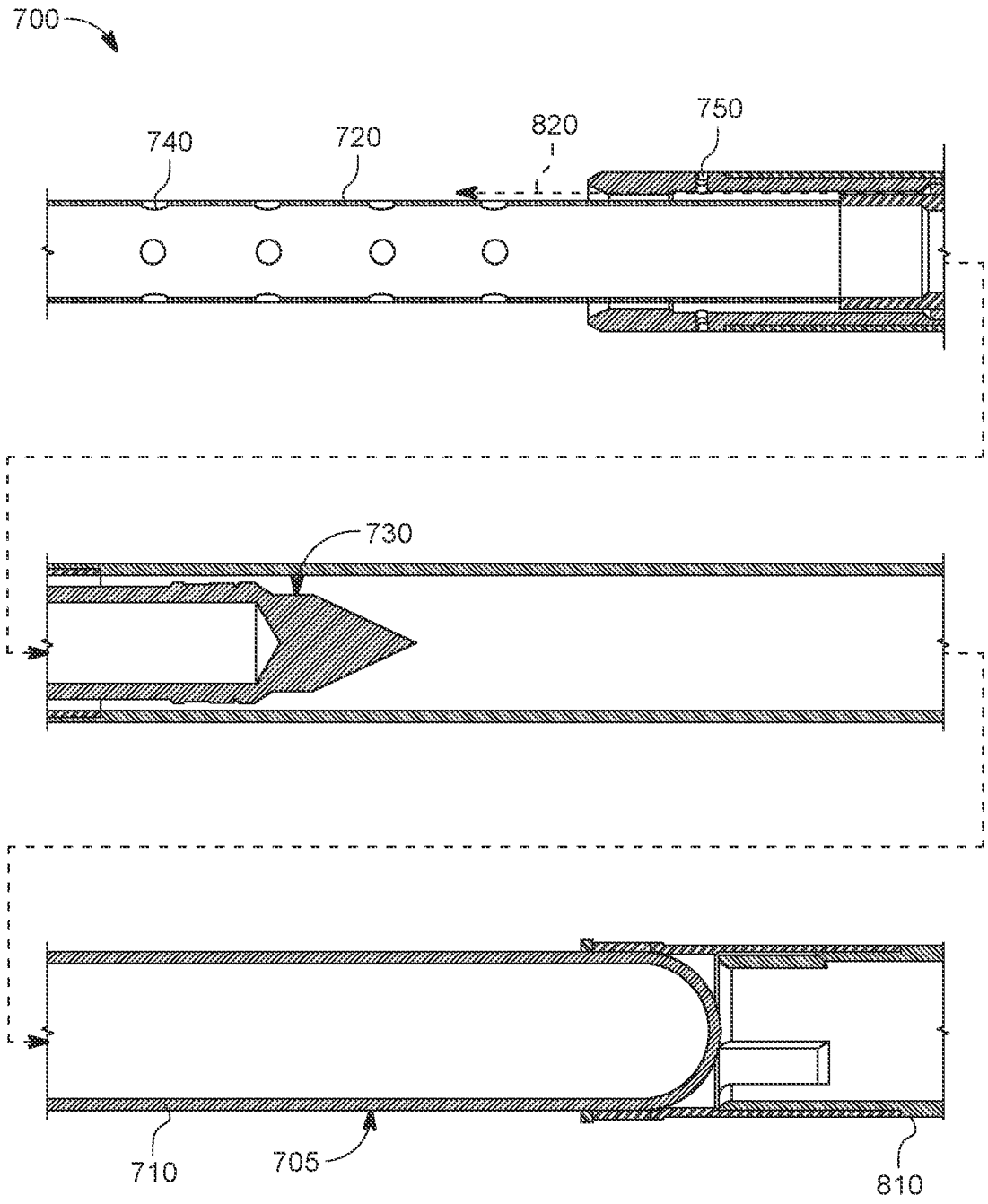
FIG. 8A illustrates a schematic cross-sectional view of a buoyant guide sub of FIGS. 7A and 7B landed in a liner.

FIG. 8A is a schematic cross-sectional view of a buoyant guide sub 700 of FIGS. 7A and 7B landed in a liner 810. In the illustrated embodiment, the liner 810 is a lateral liner, as might be found in a high-side secondary wellbore. In the illustrated embodiment of FIG. 8A, the shear feature 750 has sheared, thereby allowing the pressure to equalize within the hollow tubular structure 705, as shown by the dotted lines 820.

Figure 8B:
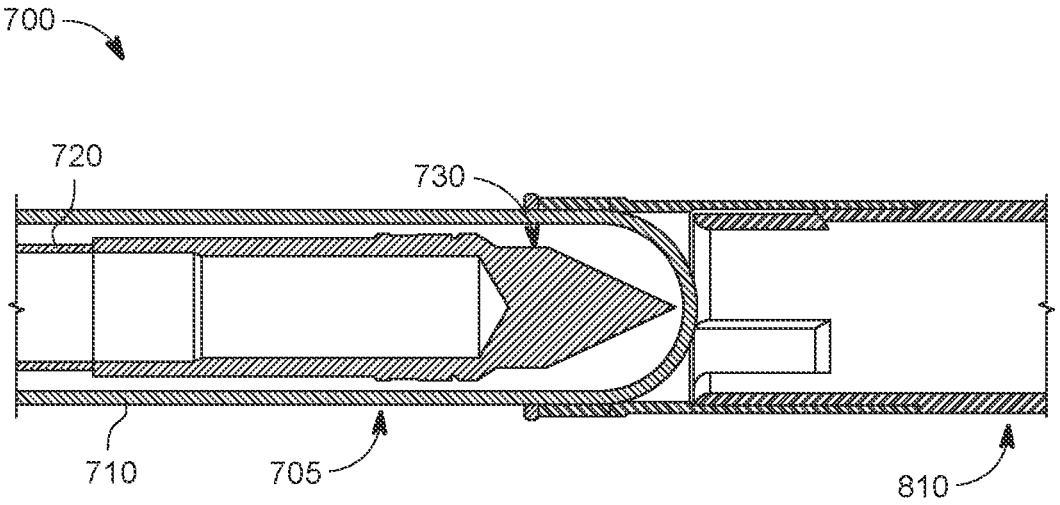
FIG. 8B illustrates a schematic cross-sectional view of a buoyant guide sub of FIG. 8A after the piercing has pierced the end of the hollow tubular structure.
Figure 8C:
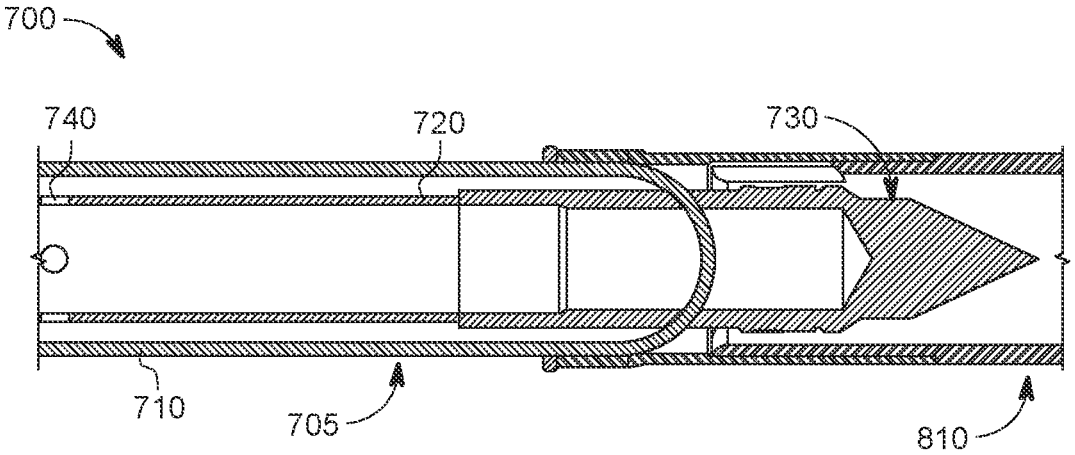
FIG. 8C illustrates a schematic cross-sectional view of a buoyant guide sub of FIG. 8B after the piercing device is approaching an end of the hollow tubular structure and FIGS. 9A to 9F illustrate an alternative example of using a buoyant guide sub to traverse a high-side exit of a multilateral junction in a well system.

FIG. 8B is a schematic cross-sectional view of a buoyant guide sub 700 of FIG. 8A after the piercing device 730 is approaching an end of the hollow tubular structure 705. In contrast, FIG. 8C is a schematic cross-sectional view of a buoyant guide sub 700 of FIG. 8B after the piercing device 730 has pierced the end of the hollow tubular structure 705.

FIGS. 9A to 9F now illustrate an alternative example of using a buoyant guide sub to traverse a high-side exit of a multilateral junction in a well system 900. While FIGS. 6A to 6D illustrate the use of the buoyant guide sub to position a multilateral junction assembly, FIGS. 9A to 9F illustrate the use of the buoyant guide sub to position any conveyance (e.g., oilfield tubular) within a higher of the primary wellbore or the secondary wellbore, for example without using a deflector assembly.

Figure 9A:
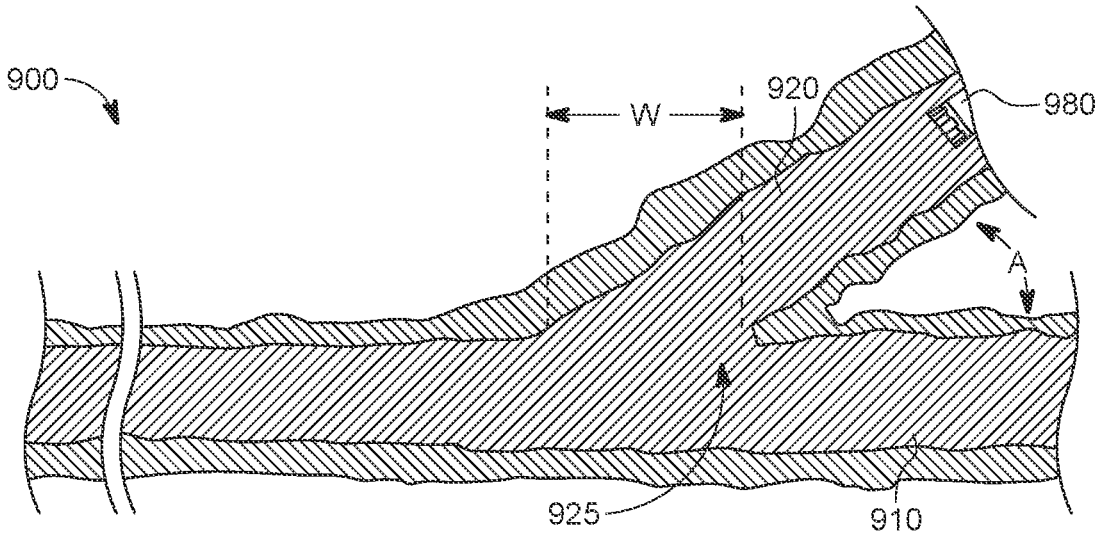

FIG. 9A is a schematic side view of a well system 900. The well system 900, in the illustrated embodiment, includes a primary wellbore 910 and a secondary wellbore 920 forming a multilateral junction 925. In the illustrated embodiment, the secondary wellbore 920 is a high-side secondary wellbore, and thus includes a high-side exit. Nevertheless, other embodiments exist wherein the secondary wellbore 920 is a low-side secondary wellbore. The scale (e.g., horizontal scale) of FIG. 9A is compressed for ease of illustration, to exaggerate the angle "A" as drawn and narrow the width "W" for ease of discussion. In reality, the angle A may be only about 2 to 3 degrees, and the width of the high-side exit may be tens of feet long (e.g., around 30 feet long).

In the illustrated embodiment, the well system 900 additionally includes a liner 980. The liner 980, in the illustrated embodiment, may be located in the secondary wellbore 920. In the illustrated embodiment, the multilateral junction 925 is prepped for the passage of one or more oilfield conveyances therethrough. Moreover, while the well system 900 of FIG. 9A is illustrated as an open hole well system, other embodiments exist wherein the well system 900 is a cased well system. In such an embodiment, an exit would be milled in the casing proximate the high-side exit. Further to the embodiment of FIG. 9, no deflector assembly is required at the multilateral junction 925. While not necessary, other embodiments exist where a deflector assembly is employed.

Figure 9B:
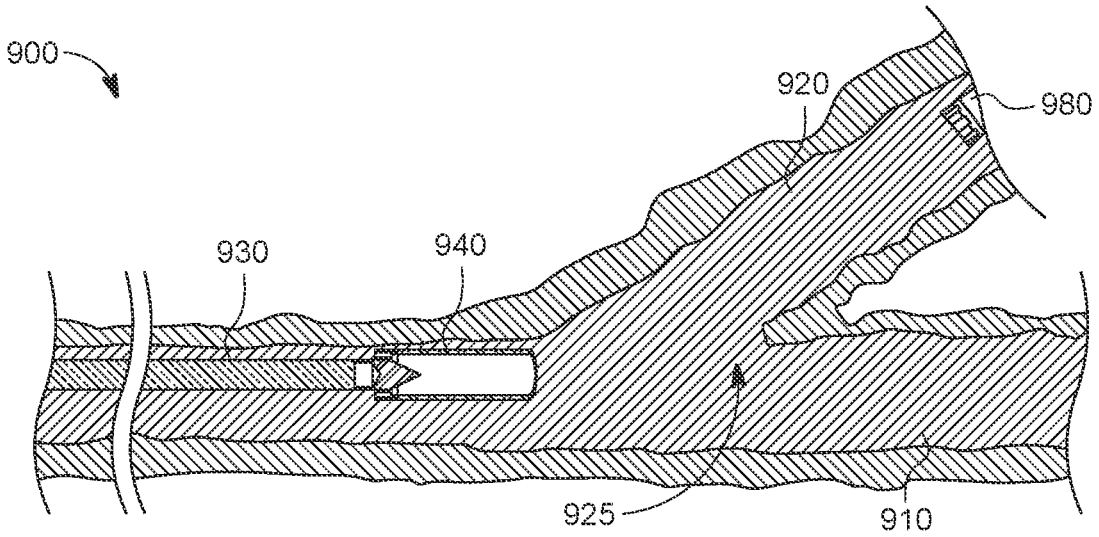

FIG. 9B is a schematic side view of the well system 900 of FIG. 9A with a buoyant guide sub 940 coupled to a conveyance device 930 traversing the primary wellbore 910. The buoyant guide sub 940, in one or more embodiments, may be similar to the buoyant guide sub 700 of FIGS. 8A through 8C. The conveyance device 930, in one or more embodiments, is tubing string. In one or more other embodiments, the conveyance device 930 is wireline, slickline or another non tubular oilfield conveyance, and for example may be used with a known or hereafter discovered wellbore tractor. Thus, in at least one embodiment, the conveyance device 930 could include, or have attached thereto, a logging device, or other intervention tool. Further to the embodiment of FIG. 9B, the conveyance device 930 may be lighter mass and/or have a smaller diameter at the junction with the buoyant guide sub 940 than further uphole. Accordingly, a portion of the conveyance device 930 proximate the buoyant guide sub 940 will have a higher degree of buoyancy, and thus be more susceptible to float into the secondary wellbore 920. In at least one other embodiment, a protective coating may be placed upon the buoyant guide sub 940 to prevent wear thereupon as it is traversing within the primary wellbore 910. The buoyant guide sub 940, in the embodiment of FIG. 9B, has reached a portion of the primary wellbore 910 just upstream of the high-side exit. While not shown, a transition sub (e.g., similar in nature to the transition sub 260 illustrated in FIG. 2B) may be coupled between the conveyance device 930 and the buoyant guide sub 940.

Figure 9C:
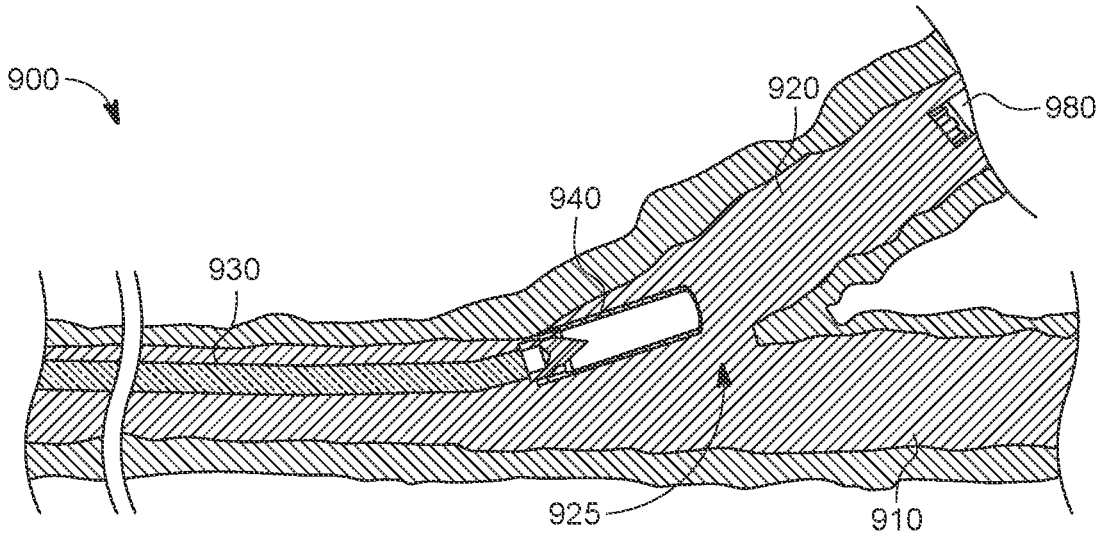

FIG. 9C is a schematic side view of the well system 900 of FIG. 9B with the buoyant guide sub 940 advanced further down the primary wellbore 910 to where the buoyant guide sub 940 floats and thus has now entered the high-side exit and begins to move into the secondary wellbore 920. Again, the low-density materials of the buoyant guide sub 940 help direct it out into the secondary wellbore 920.

Figure 9D:
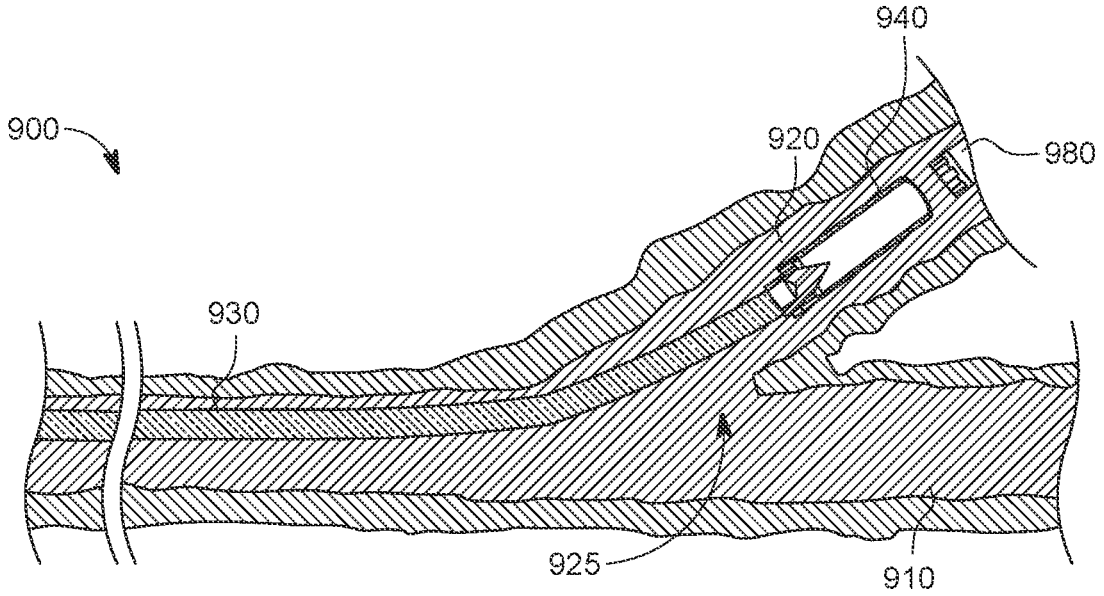

FIG. 9D is a schematic side view of the well system 900 of FIG. 9C with the buoyant guide sub 940 having advanced further down the secondary wellbore 920 and approaching the lateral liner 980.

Figure 9E:
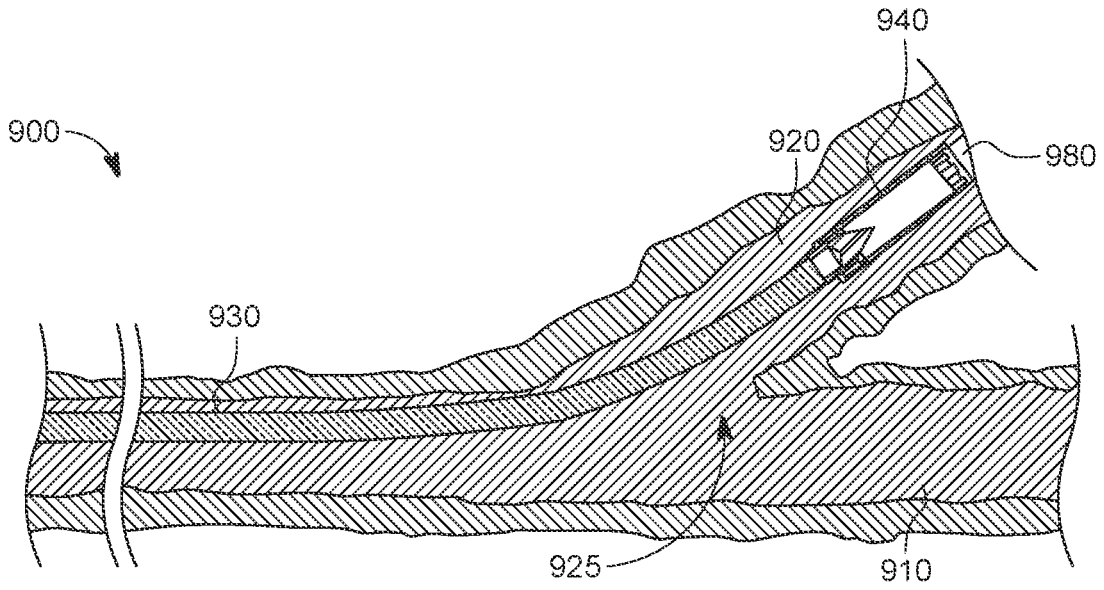

FIG. 9E is a schematic side view of the well system 900 of FIG. 9D with the buoyant guide sub 940 having just landed in the lateral liner 980. At this stage, the shear feature has not sheared, and thus a pressure differential exists across the hollow tubular structure.

Figure 9F:
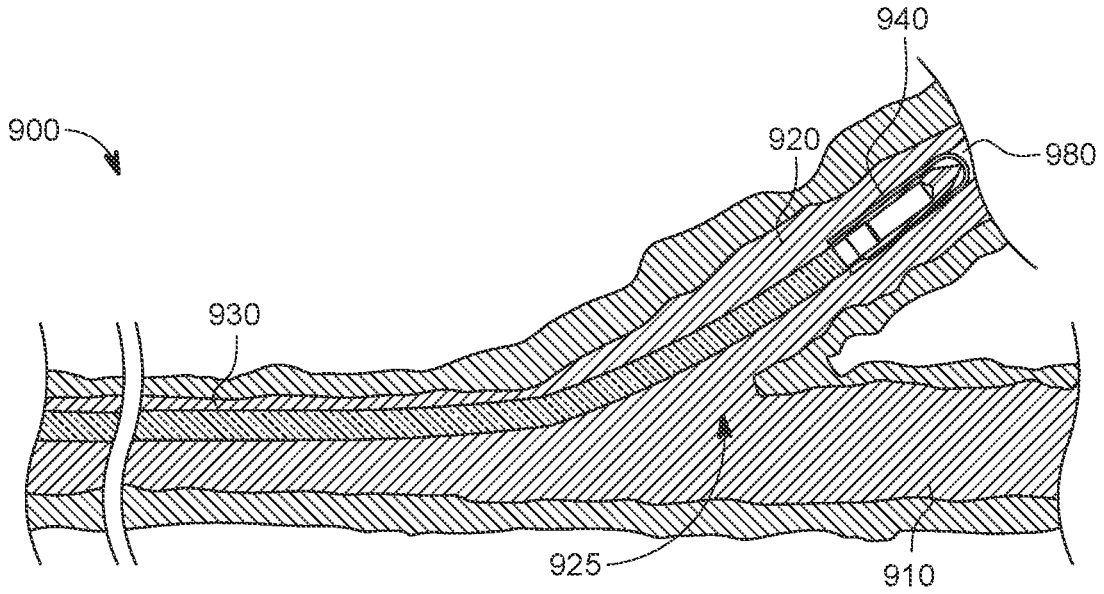

FIG. 9F is a schematic side view of the well system 900 of FIG. 9E with the buoyant guide sub 940 having landed in the lateral liner 980, and the conveyance 930 continuing to push the buoyant guide sub 940 downhole thereby shearing the shear feature and ultimately piercing the hollow tubular structure. At this stage, the pressure within the hollow tubular structure is equalized.

Aspects disclosed herein include:

A. A buoyant guide sub for use with a downhole oilfield conveyance, the buoyant guide sub including: 1) a hollow tubular structure, the hollow tubular structure including one or more tubular walls; and 2) a housing coupled to and slidable relative to the hollow tubular structure, the hollow tubular structure and the housing operable to form a pressurized chamber, the hollow tubular structure and housing having a combined mass per unit volume less than a specific gravity of 2.

B. A method, the method including: 1) advancing an oilfield conveyance along a primary wellbore toward a multilateral junction having a high-side exit to a secondary wellbore, the oilfield conveyance having a buoyant guide sub positioned at a leading end thereof, the buoyant guide sub having a buoyancy within a well fluid external to the buoyant guide sub; and 2) using the buoyancy of the buoyant guide sub to bias the buoyant guide sub toward a high-side of the primary wellbore while moving the buoyant guide sub into the high-side exit to a downstream portion of the secondary wellbore.

C. A well system, the well system including: 1) a primary wellbore; 2) a secondary wellbore extending from a high-side of the primary wellbore, the primary wellbore and secondary wellbore forming a multilateral junction; and 3) an oilfield conveyance having a buoyant guide sub positioned at a leading end thereof, the buoyant guide sub having a combined mass per unit volume less than a specific gravity of 2.

Aspects A, B, and C may have one or more of the following additional elements in combination: Element 1: wherein the housing includes a piercing device coupled thereto, the piercing device configured to pierce the hollow tubular structure when the housing slides relative to the hollow tubular structure. Element 2: further including one or more shear features temporarily fixing the housing relative to the hollow tubular structure to form the pressurized chamber. Element 3: further including one or more seals positioned between the housing and the hollow tubular structure to prevent fluids or gasses from entering or exiting the hollow tubular structure until the one or more shear features have sheared. Element 4: wherein the hollow tubular structure and housing have a combined mass per unit volume less than a specific gravity of 1.5. Element 5: wherein the hollow tubular structure and housing have a combined mass per unit volume less than a specific gravity of 1. Element 6: further including: generating the buoyancy using a hollow tubular structure filled with a gas; and pressurizing the gas to offset a hydrostatic pressure external to the buoyant guide sub. Element 7: further including piercing an end wall of the buoyant guide sub after moving the buoyant guide sub across the high-side exit, to provide through-tube access for fluid or the oilfield conveyance into the secondary wellbore. Element 8: further including supplementing the buoyancy of the buoyant guide sub by urging the buoyant guide sub upwardly using a mechanical spring. Element 9: wherein the oilfield conveyance comprises a leg of a multi-bore junction assembly, and the buoyant guide sub guides the leg into the high-side exit. Element 10: wherein the leg is a secondary wellbore leg. Element 11: further including dissolving at least a portion of the buoyant guide sub after moving the buoyant guide sub into the high-side exit and to a downstream portion of the secondary wellbore. Element 12: wherein the buoyant guide sub includes: a hollow tubular structure, the hollow tubular structure including one or more tubular walls; and a housing coupled to and slidable relative to the hollow tubular structure, the hollow tubular structure and the housing operable to form a pressurized chamber. Element 13: wherein the housing includes a piercing device coupled thereto, the piercing device configured to pierce the hollow tubular structure when the housing slides relative to the hollow tubular structure. Element 14: further including one or more shear features temporarily fixing the housing relative to the hollow tubular structure to form the pressurized chamber. Element 15: further including one or more seals positioned between the housing and the hollow tubular structure to prevent fluids and/or gasses from entering and/or exiting the hollow tubular structure until the one or more shear features have sheared. Element 16: wherein the hollow tubular structure and housing have a combined mass per unit volume less than a specific gravity of 1.5. Element 17: wherein the hollow tubular structure and housing have a combined mass per unit volume less than a specific gravity of 1.

Those skilled in the art to which this application relates will appreciate that other and further additions, deletions, substitutions and modifications may be made to the described embodiments.

What is claimed is:

1. A buoyant guide sub for use with a downhole oilfield conveyance, comprising:

a hollow tubular structure, the hollow tubular structure including one or more tubular walls; and a housing coupled to and slidable relative to the hollow tubular structure, the hollow tubular structure and the housing operable to form a pressurized chamber, the hollow tubular structure and housing having a combined mass per unit volume less than a specific gravity of 2, wherein the housing includes a piercing device coupled thereto. the piercing device configured to pierce the hollow tubular structure when the housing slides relative to the hollow tubular structure.

2. The buoyant guide sub as recited in claim 1, further including one or more shear features temporarily fixing the housing relative to the hollow tubular structure to form the pressurized chamber.

3. The buoyant guide sub as recited in claim 2, further including one or more seals positioned between the housing and the hollow tubular structure to prevent fluids or gasses from entering or exiting the hollow tubular structure until the one or more shear features have sheared.

4. The buoyant guide sub as recited in claim 1, wherein the hollow tubular structure and housing have a combined mass per unit volume less than a specific gravity of 1.5.

5. The buoyant guide sub as recited in claim 1, wherein the hollow tubular structure and housing have a combined mass per unit volume less than a specific gravity of 1.

6. A method, comprising:

advancing an oilfield conveyance along a primary wellbore toward a multilateral junction having a high-side exit to a secondary wellbore, the oilfield conveyance having a buoyant guide sub positioned at a leading end thereof, the buoyant guide sub including:

a hollow tubular structure, the hollow tubular structure including one or more tubular walls: and a housing coupled to and slidable relative to the hollow tubular structure, the hollow tubular structure and the housing operable to form a pressurized chamber, the hollow tubular structure and housing having a combined mass per unit volume less than a specific gravity of 2, wherein the housing includes a piercing device coupled thereto, the piercing device configured to pierce the hollow tubular structure when the housing slides relative to the hollow tubular structure; and using the buoyancy of the buoyant guide sub to bias the buoyant guide sub toward a high-side of the primary wellbore while moving the buoyant guide sub into the high-side exit to a downstream portion of the secondary wellbore.

7. The method of claim 6, further including:

generating the buoyancy using a hollow tubular structure filled with a gas; and pressurizing the gas to offset a hydrostatic pressure external to the buoyant guide sub.

8. The method of claim 6, further including piercing an end wall of the buoyant guide sub after moving the buoyant guide sub across the high-side exit, to provide through-tube access for fluid or the oilfield conveyance into the secondary wellbore.

9. The method of claim 6, further including supplementing the buoyancy of the buoyant guide sub by urging the buoyant guide sub upwardly using a mechanical spring.

10. The method of claim 6, wherein the oilfield conveyance comprises a leg of a multi-bore junction assembly, and the buoyant guide sub guides the leg into the high- side exit.

11. The method of claim 10, wherein the leg is a secondary wellbore leg.

12. The method of claim 6, further including dissolving at least a portion of the buoyant guide sub after moving the buoyant guide sub into the high-side exit and to a downstream portion of the secondary wellbore.

13. A well system, comprising:

a primary wellbore;

a secondary wellbore extending from a high-side of the primary wellbore, the primary wellbore and secondary wellbore forming a multilateral junction; and an oilfield conveyance having a buoyant guide sub positioned at a leading end thereof, the buoyant guide sub including:

a hollow tubular structure, the hollow tubular structure including one or more tubular walls: and a housing coupled to and slidable relative to the hollow tubular structure, the hollow tubular structure and the housing operable to form a pressurized chamber, the hollow tubular structure and housing having a combined mass per unit volume less than a specific gravity of 2, wherein the housing includes a piercing device coupled thereto, the piercing device configured to pierce the hollow tubular structure when the housing slides relative to the hollow tubular structure.

14. The well system as recited in claim 13, further including one or more shear features temporarily fixing the housing relative to the hollow tubular structure to form the pressurized chamber.

15. The well system as recited in claim 14, further including one or more seals positioned between the housing and the hollow tubular structure to prevent fluids and/or gasses from entering and/or exiting the hollow tubular structure until the one or more shear features have sheared.

16. The well system as recited in claim 13, wherein the hollow tubular structure and housing have a combined mass per unit volume less than a specific gravity of 1.5.

17. The well system as recited in claim 13, wherein the hollow tubular structure and housing have a combined mass per unit volume less than a specific gravity of 1.

* * * * *